US007201496B2

(12) United States Patent
Holten

(10) Patent No.: US 7,201,496 B2
(45) Date of Patent: Apr. 10, 2007

(54) LUMINAIRE AND LAMELLAE LOUVER THEREFOR

(75) Inventor: Petrus Adrianus Josephus Holten, Winterswijk (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 151 days.

(21) Appl. No.: 10/523,155

(22) PCT Filed: Jul. 31, 2003

(86) PCT No.: PCT/IB03/03710

§ 371 (c)(1),
(2), (4) Date: Jan. 27, 2005

(87) PCT Pub. No.: WO2004/013537

PCT Pub. Date: Feb. 12, 2004

(65) Prior Publication Data

US 2005/0243557 A1 Nov. 3, 2005

(30) Foreign Application Priority Data

Aug. 1, 2002 (EP) ..... 02078155

(51) Int. Cl.
*F21V 11/02* (2006.01)

(52) U.S. Cl. ..... 362/291; 362/279; 362/292; 362/325; 362/342; 362/354

(58) Field of Classification Search ..... 362/147, 362/279, 290–292, 325, 342, 354
See application file for complete search history.

(56) References Cited

U.S. PATENT DOCUMENTS

| | | | | |
|---|---|---|---|---|
| 5,758,954 | A * | 6/1998 | Holten et al. | 362/291 |
| 5,908,234 | A * | 6/1999 | Kreeft | 362/223 |
| 6,582,099 | B2 * | 6/2003 | Bartenbach | 362/291 |
| 6,616,307 | B2 * | 9/2003 | Haenen et al. | 362/341 |
| 6,626,560 | B1 * | 9/2003 | Caferro et al. | 362/290 |
| 7,040,781 | B2 * | 5/2006 | Kosters et al. | 362/291 |

FOREIGN PATENT DOCUMENTS

| | | |
|---|---|---|
| EP | 0757772 B1 | 2/1997 |
| WO | WO9625623 | 8/1996 |

* cited by examiner

*Primary Examiner*—Sandra O'Shea
*Assistant Examiner*—Jason Moon Han

(57) ABSTRACT

A luminaire has side reflectors having edges defining the width W of a light-emission window, and a plurality of lamellae, which have a concave outer edge in the light-emission window and an inner face remote from that window. In the centers of the lamellae, the lamellae have a distance $h_o$ between the outer edge and the inner face that is <0.1 W. As a result, the total surface area of the inner face is relatively small. Internal reflections are thereby reduced, and a higher light output is obtained. If the lamellae are solid and made of plastic, less material is required for their fabrication. In a preferred embodiment, $h_o$<0.05 W, and the inner face may then be convex and even have the same contour as the outer edge. The lamellae louver has lamellae of $h_o$<W, in which W is also the length of the lamellae.

10 Claims, 5 Drawing Sheets

PRIOR ART

LUMINAIRE AND LAMELLAE LOUVER THEREFOR

The invention relates to a luminaire provided with:

a light-emission window of a width W;

elongate side reflectors, mounted opposite each other, equidistant from a plane P that is at right angles to the light-emission window, which side reflectors have an edge defining the width W of the light-emission window;

means for accommodating an electric lamp between the side reflectors along the light-emission window;

a plurality of substantially parallel, substantially equidistant lamellae transverse to plane P, the lamellae having V-shaped cross-sections and, which lamellae have a concave outer edge in the light-emission window, an inner face remote from the light-emission window, a distance $h_o$ between the outer edge and the inner face in plane P, and flanks from the outer edge to the inner face.

The invention also relates to a lamellae louver comprising a plurality of substantially parallel, substantially equidistant, interconnected lamellae with a V-shaped cross-section having:

a length W;

a concave outer edge in a light-emission window;

an inner face remote from the light-emission window; and flanks extending from the outer edge to the inner face; and, in a center of a lamella, a distance $h_o$ between the outer edge and the inner face.

An embodiment of such a luminaire is known from EP-A-0 757 772.

The function of the side reflectors is to collect the light generated by an accommodated lamp into a beam and furthermore, to create a shielding angle, within which the lamp is not visible. The shielding angle extends in a plane at right angles to the edge of the side reflectors, the $C_0$ plane, from a plane S through the edges of the side reflectors. This shielding angle is especially important in spaces where monitors are used, in order to prevent annoying reflections. The side reflectors also provide screening in planes surrounding the $C_0$ plane.

The lamellae have a similar shielding function in plane P, which is also called the $C_{-90}$ plane, and the planes surrounding it. To achieve that a similar shielding is obtained in said surrounding planes, the outer edge of the lamellae is concave. The said distance $h_o$, the height of the lamella in situ, and the interspacing of the lamellae decide the size of the shielding angle in plane P given by the lamellae. The shielding angle $\alpha$, see FIG. 1 showing a cross-section of lamellae 10 in plane P, decreases when the interspacing of the lamellae 10 is increased from d to D, and when the height is reduced from $H_0$ to $h_o$.

The side reflectors and the lamellae work together to create a shielding angle around the luminaire, within which the lamp accommodated is not directly visible.

In general, the side reflectors are shaped in such a way that they concentrate light coming straight from the lamp into a beam, and consequently reflect it outside the shielding angle.

The lamellae may have concave flanks in plane P, and also next to this plane, in order to reflect incident light in the beam, at a greater angle to plane S than the angle at which the light falls onto the lamellae. In that case, the luminaire can be used in spaces with monitors, because the lamellae also prevent radiation of light in the shielding angle. Alternatively, the lamellae may have flat flanks in plane P, and also next to this plane, which—since the lamellae have a V-shaped cross-section—reflect incident light at a greater angle to plane S than the angle of incidence.

In the known luminaire, the lamellae either have a straight inner face, which is profiled in the case of specular or semi-specular lamellae, or an inner face ascending towards the side reflectors. The purpose of the profile or the ascending inner face is to ensure that light shed onto the inner face by the lamp is reflected by the inner face to a location of the side reflectors situated deeper in the luminaire. This is to prevent the occurrence of annoying bright spots of light reflected by the inner face and subsequently by the side reflectors within the shielding angle.

The lamellae have another additional function, which is fulfilled by the flanks due to the fact that the inner face is straight or even ascends towards the side reflectors, and the fact that the flanks extend as far as the inner face. The lamellae thus obviate clear mirror images of the accommodated lamp being observed in the side reflectors from the shielding angle, at the angles in the range from ca 30°–40° to plane P, in which those mirror images originate. This is illustrated in FIGS. 2 and 3.

FIG. 2 shows a section of a luminaire, viz. a side reflector 2 with three lamellae 10 in perspective view. One zone of the side reflector, which is visible above the lamella that is at the front in FIG. 2, in the position shown, produces mirror images of the burning lamp accommodated within the shielding angle, where the observer of the luminaire is located. This zone is not visible above the central and rearmost lamellae, because the flanks 13 of the lamellae cover the zone correctly in those places. This happens although the outer edges 11 of the lamellae are concave and are therefore much closer in the perspective view shown to the inner face 12 (which is, after all, the boundary of the flank of the adjacent lamella) than if the lamellae were to have a straight outer edge, as indicated by the broken line.

FIG. 3 shows a section of another luminaire in perspective view. In this luminaire, the lamellae 10 are plates with a concave outer edge 11. The inner edge 12' is not concave, owing to the fact that the lamellae do not ascend towards the side reflectors. The inner edge is not even straight, but is convex, and of the same curvature as the outer edge. As a result of the convex inner edge, the lamellae no longer complement one another—which is the case in FIG. 2—and do not screen the zone of the side reflector above the lamellae. The observer can see clear mirror images of the lamp from the shielding angle. The luminaire shown is therefore not suitable for use in spaces where monitors are used.

A drawback of the known luminaire is that the inner face of the lamellae has a relatively large surface area, and is exposed to a relative large luminous flux from the accommodated lamp. This leads to additional reflections on the side reflectors. Reflections in the luminaire cause a loss of light, because materials absorb a fraction of the incident light.

It is a first object of the invention to provide a luminaire of the kind described in the opening section which allows relatively few reflections on the inner faces.

A second object of the invention is to provide a lamellae louver of the kind described in the opening section which allows relatively few reflections on the inner faces when used in a luminaire.

It has been found by experiment that the first object according to the invention is realized in that $h_o<0.1$ W. Since relatively few reflections occur on the inner faces, the loss of light is counteracted, and the luminaire has a relatively high efficiency.

If, in a luminaire with a chosen shielding angle, which, as mentioned, is determined transverse to plane P by the edge of the side reflectors and the position of the lamp—so by the position of the means for accommodating the lamp—the lamellae have, according to the invention, the small value of $h_o$ mentioned above (the dimension $h_o$ also being referred to here as height), they are situated at a greater distance from the accommodated lamp, and the inner face of each lamella is therefore within a smaller angle as seen from the lamp, so that the lamella is hit by less light and fewer reflections take place on it. Furthermore, the lamellae—which have a V-shaped cross-section—have a relatively small height, so that the flanks will be less far apart from the outer edge, and the inner face has a relatively small width, cf. FIG. 4. In FIG. 4, β1 is the angle within which light from a point of the lamp is hits the inner face of a lamella 10 in a conventional luminaire, β2 is the angle within which this happens if the inner face of the lamella were to be at a greater distance from the lamp, and β3 is the angle concerned in a lamella of the luminaire according to the invention, in which the flanks 13 are at the same angle. FIG. 4 diagrammatically shows the differences with lamellae with flat flanks, but if the flanks are concave, which is often the case, the width of the inner faces increases more than linearly with increasing height. If the luminaire according to the invention is provided with lamellae with concave flanks, the relative size of β3 is even smaller.

It is noted that $h_o$ is about 0.2 to 0.4 W in conventional luminaries.

FIG. 5, representing a section of the luminaire according to the invention, the section being analogous to and in a position analogous to FIG. 2, shows that the lamellae 10 completely screen the area of the side reflectors 2 in which mirror images of the lamp can be visible. Even sections that are located relatively far away from the edge of the side reflector, between the lamellae, which are still unscreened in FIG. 2 and in which mirror images may still be visible, are screened in FIG. 5. In FIG. 5, contrary to FIG. 2, the part of the side reflector that is still visible is only very small. This is an important advantage of the luminaire according to the invention.

The lamellae may be shaped from plate material, e.g. from specular or semi-specular material, for example from aluminum. Alternatively, the lamellae may be shaped from plastics. They may be translucent for decorative applications, or non-translucent. They may be white, for example, or reflectorized. If the luminaire according to the invention is provided with plastic lamellae, there is another advantage in that the amount of material used to build the lamellae is smaller than in a conventional luminaire.

It is favorable for the amount of material used to build the lamellae in general, so also for lamellae made of plate material, if the inner face is substantially straight. In this case, the inner face does not ascend towards the side reflectors, but runs basically parallel to plane S.

In a special embodiment, $h_o$<0.05 W in the luminaire. The inner face may then be convex, as was also found by experiment. When comparing FIG. 5 with FIG. 2, it is clear that in the case of the lamellae with small height, the small $h_o$ of FIG. 5,—which are closer together to provide the same screening as in FIG. 2—it is no longer the center of the outer edge 11 that works together with an end of the flank 13 to screen the side reflector, as in FIG. 2, but is a section of the outer edge lying much closer to the side reflector, where the outer edge lies closer to plane S through the edges of the side reflectors. The flanks of the lamellae may then even have the same contour on the inner face 12 as on the outer edge. In this way, a further saving of material is realized. In general, $h_o$ is greater than 0.03 W, because of the form-retaining properties of the lamellae.

To create a light beam of high quality, it is favorable if the lamellae are specular and the inner face is profiled, in order to reflect incident light to places of the side reflector that are located relatively deep in the luminaire. In the case of lamellae made of sheet metal, this profile may, for example, comprise tongues pressed inwards or outwards from the inner face. In the case of lamellae made of plastics, the inner face may, for example, have a stepped structure.

The lamellae may be connected inseparably to the side reflectors. Alternatively, the lamellae may be interconnected into a louver, to form a lamellae louver according to the invention.

The luminaire may be destined for use with one or more linear fluorescent lamps, or with one or more fluorescent lamps having two or more essentially parallel lamp-vessel parts. The side reflectors may extend together around an accommodated lamp, and be integrated.

The second object of the invention is realized in that $h_o$<0.1 W. The rest of what has been explained above with respect to the luminaire according to the invention similarly applies to the lamellae louver.

The lamellae of the louver may, for example, be interconnected by means of strips that extend transverse to the lamellae, and in the case of a louver mounted in a luminaire, they may lie, for example, be near or against a respective side reflector. Such a louver is especially attractive if it is made of plastic, because in that case it can be made of one piece and there is no need for positioning the lamellae relative to one another, thus avoiding a considerable effort in mounting the lamellae.

The invention, an embodiment of the luminaire and of the lamellae louver according to the invention, is shown in the drawings and explained.

Corresponding components have been given the same reference numerals throughout the Figures.

FIGS. 1–5 have been explained above.

Figure 6:
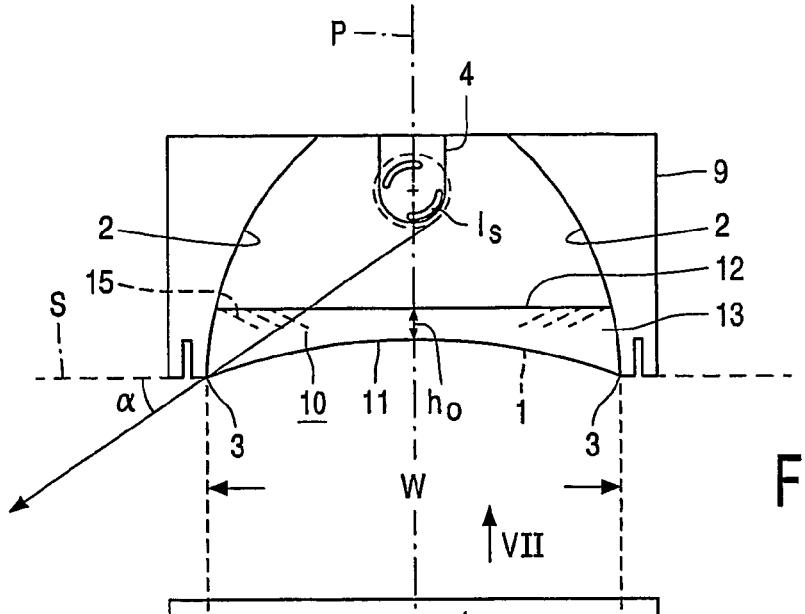
FIG. 6 shows another embodiment of the luminaire according to the invention in cross-section.
Figure 7:
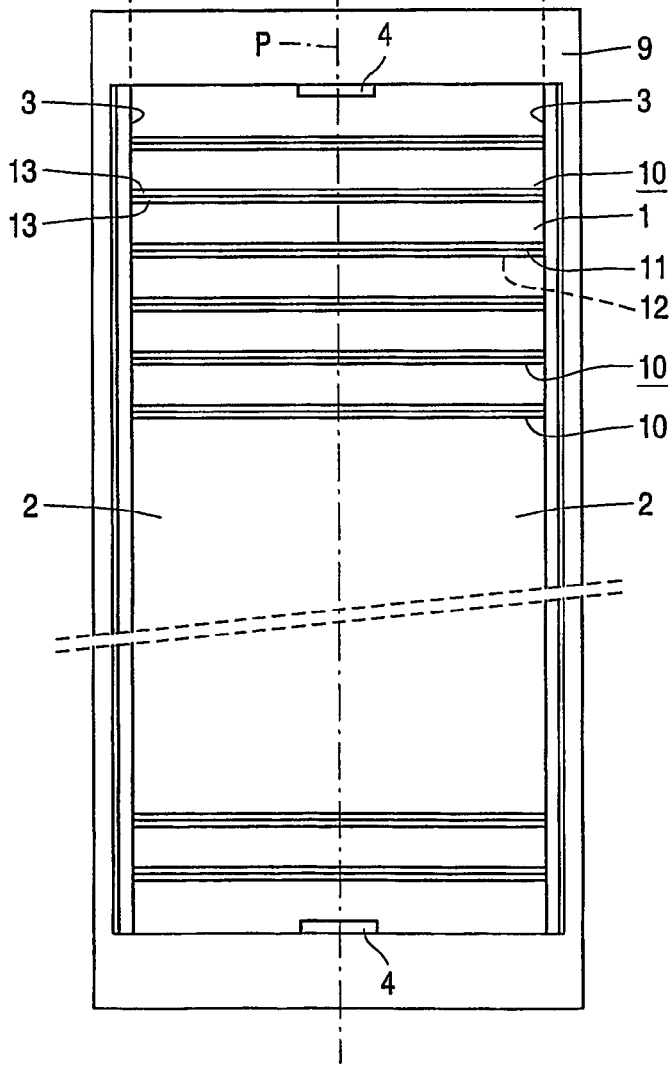
FIG. 7 shows the luminaire of FIG. 6 viewed along VII in FIG. 6.

In FIGS. 6 and 7, the luminaire has a light-emission window 1 of a width W. Elongate side reflectors 2 are placed opposite each other, equidistant from a plane P that is at right angles to the light-emission window 1. The side reflectors 2 have an edge 3, which determines the width W of the light-emission window 1. Means 4 are provided for accommodating an electric lamp 1*s* between the side reflectors 2 along the light-emission window 1. A plurality of substantially parallel, substantially equidistant, lamellae with a V-shaped cross-section are positioned transverse to plane P. The lamellae 10 have a concave outer edge 11 in the light-emission window 1, an inner face 12 remote from the light-emission window 1, a distance $h_o$ between the outer edge 11 and the inner face 12 in plane P, and flanks 13 extending from the outer edge 11 to the inner face 12. The luminaire has a housing 9.

In the luminaire shown: $h_o<0.1$ W.

Figure 1:
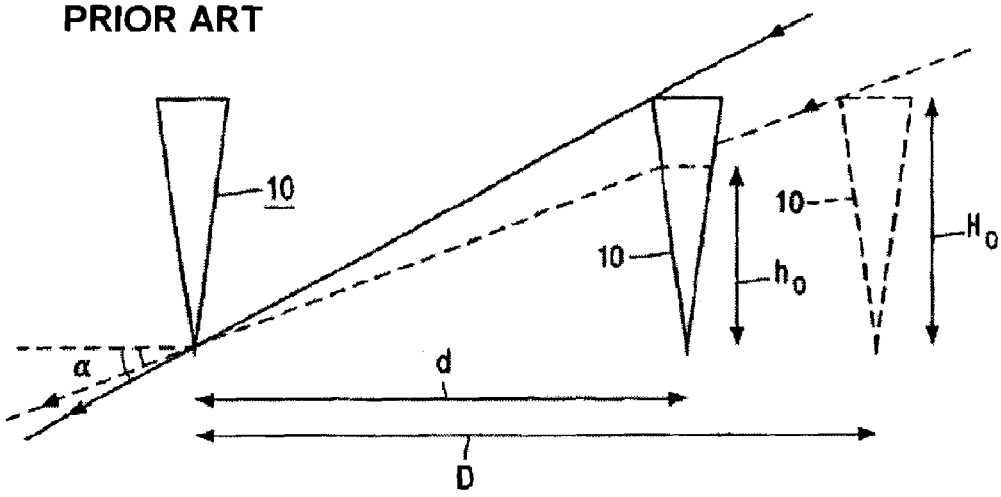
FIG. 1 PRIOR ART
FIG. 1 shows lamellae in cross-section through their centers.
Figure 2:
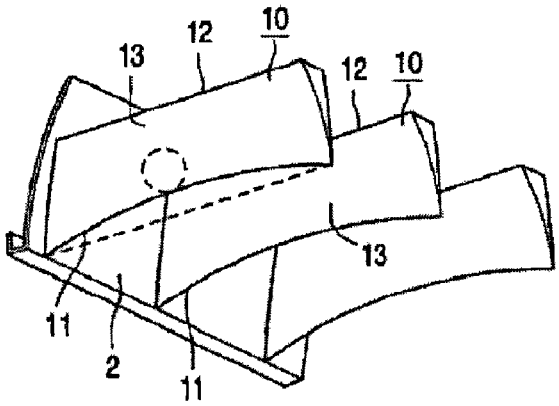
FIG. 2 shows a section of a luminaire, not according to the invention, in perspective view.
Figure 3:
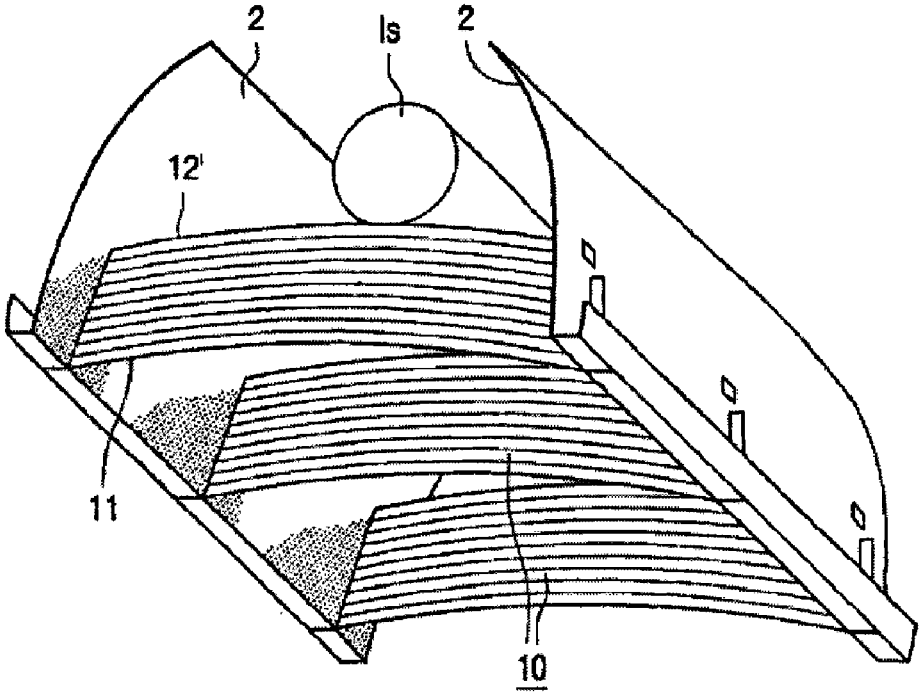
PRIOR ART FIG. 3
FIG. 3 shows a section of another luminaire, not according to the invention, in perspective view.
Figure 4:
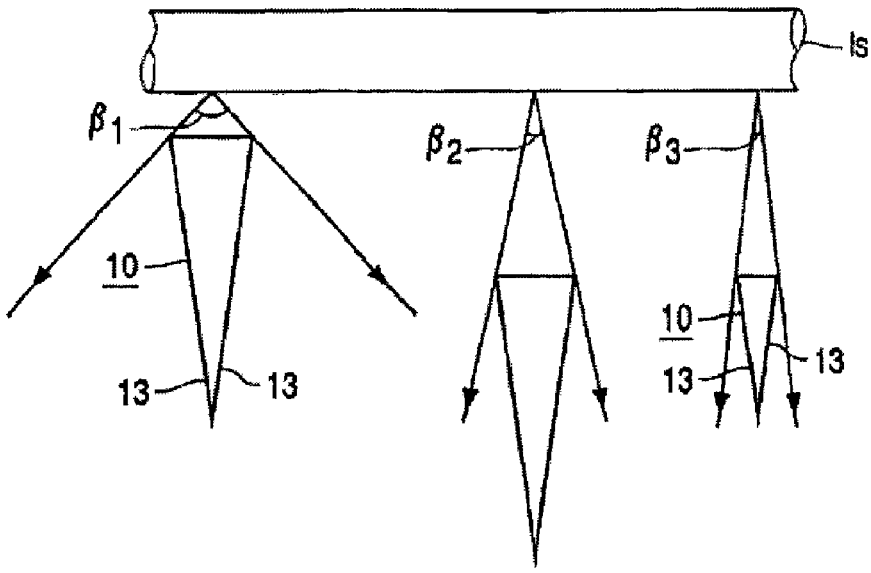
FIG. 4 shows a lamp in side elevation with lamellae in cross-section.

A plane S passes through the edges 3 of the side reflectors 2. A ray of light leaving from the circumference of the accommodated lamp, a straight tubular fluorescent lamp in the luminaire shown, and just missing an edge encloses a shielding angle $\alpha$ with plane S. In plane P, the lamellae 10, cf. FIG. 1, give the same shielding angle. The lamellae 10 give the same screening in planes on both sides of plane P; the side reflectors also give screening in planes around the plane of the drawing, FIG. 6.

The inner face 12 is substantially straight. It runs parallel to plane S.

The lamellae 10 reflect light specularly and the inner face 12 is profiled by means of tongues 15 cut loose from the inner face 12 and pressed inwards.

The side reflectors 2 and the lamellae 10 in FIGS. 6 and 7 form an integral whole and are assembled from aluminum parts.

Figure 5:
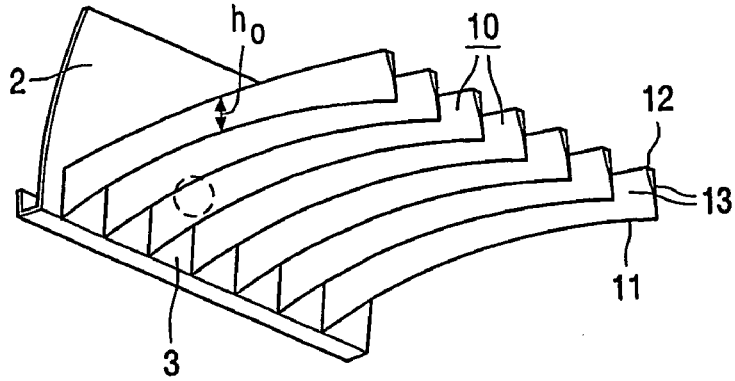
FIG. 5 shows a section of an embodiment of the luminaire according to the invention in perspective view.

In the section of an embodiment of the luminaire of FIG. 5 the lamellae have $h_o<0.05$ W. The inner face 12 of the lamellae 10 is convex.

Figure 8:
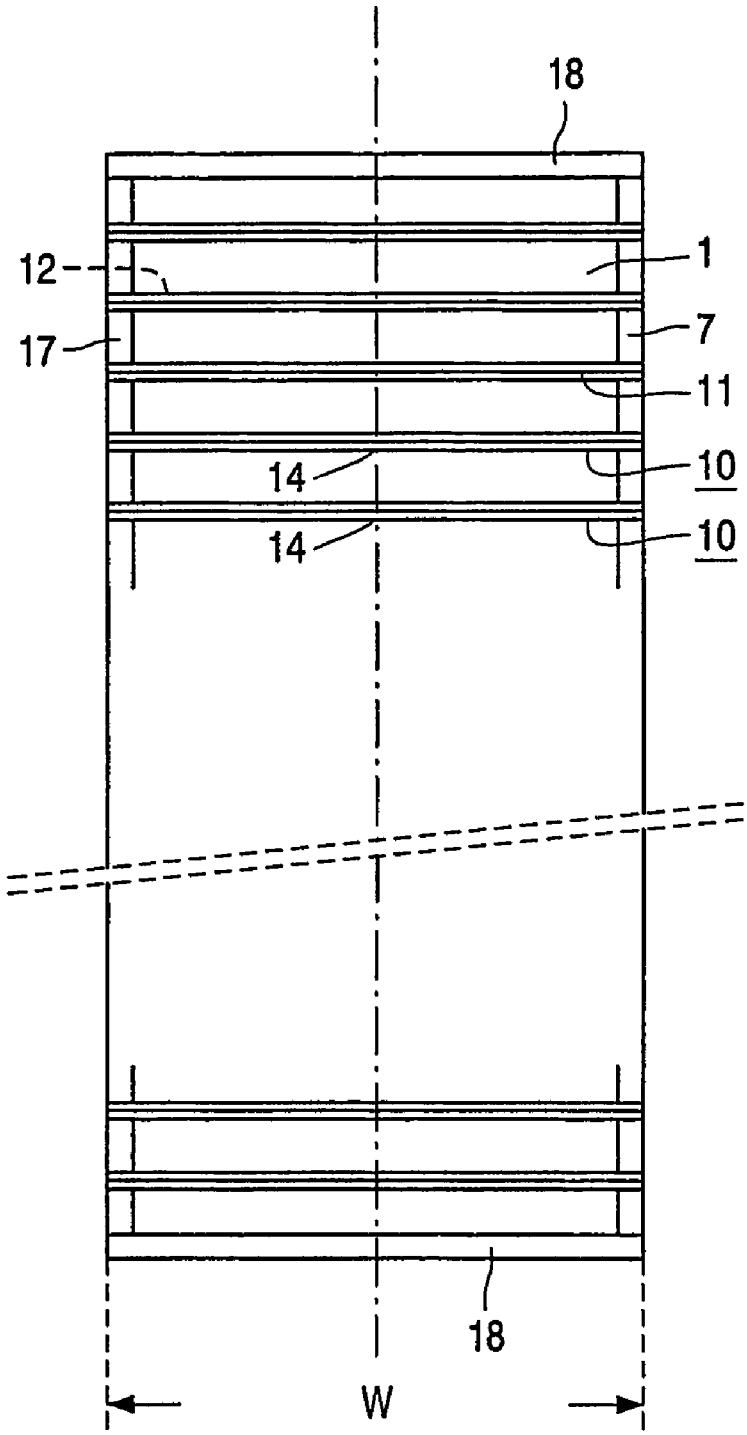
FIG. 8 shows an embodiment of the lamellae louver according to the invention, in a position corresponding to that of FIG. 7.

The lamellae louver of FIG. 8 has a plurality of substantially parallel, substantially equidistant, interconnected lamellae 10 with a V-shaped cross-section and of a length W. The lamellae 10 are interconnected by means of strips 17, which are interconnected by means of cross strips 18. The lamellae 10 have a concave outer edge 11 in a light-emission window 1, see FIG. 9, and an inner face 12 remote from the light-emission window 1. Flanks 13 extend from the outer edge 11 to the inner face 12. In their center 14, the lamellae 10 have a distance $h_o$ between the outer edge 11 and the inner face 12.

In this case the following applies: $h_o<0.1$ W. In the embodiment shown, $h_o<0.05$ W also applies.

Figure 9:
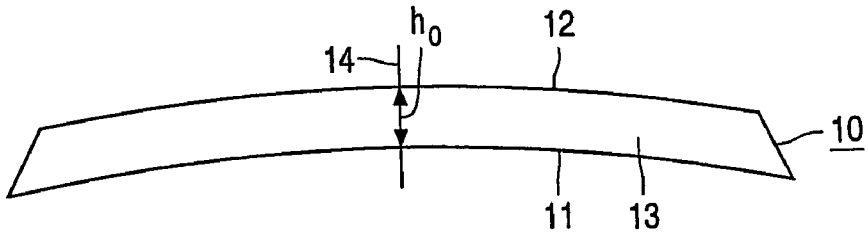
FIG. 9 shows the lamella of an embodiment, other than that shown in FIGS. 5 to 8, in front elevation.

The inner face 12 is convex and has the same curvature as the outer edge 11 in FIG. 9.

Figure 10:
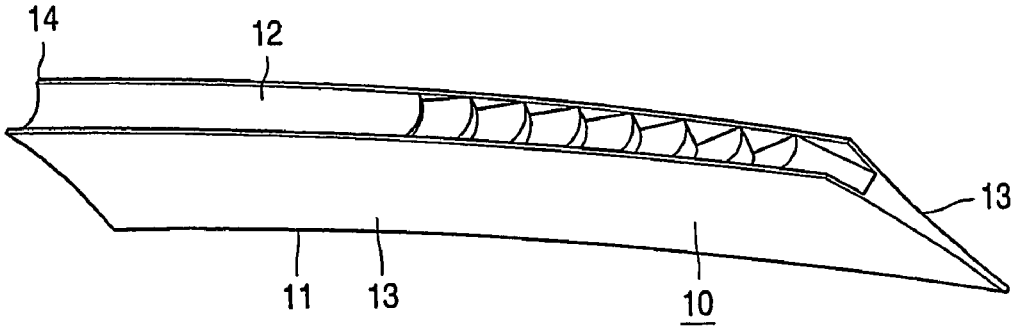
FIG. 10 shows one half of the lamella of FIG. 9 in perspective view.

The lamellae 10 are specular and the inner face 12 is profiled, as can be seen from FIG. 10.

The louver of FIG. 8 is made of plastic and forms one integral whole, which is formed in a mold and then aluminized to produce a mirror finish.

The invention claimed is:

1. A luminaire provided with:

a light-emission window of a width W;

elongate side reflectors, placed opposite each other, equidistant from a plane P that is at right angles to the light-emission window, which side reflectors have an edge defining the width W of the light-emission window;

means for accommodating an electric lamp between the side reflectors along the light-emission window;

a plurality of substantially parallel, substantially equidistant lamellae with a V-shaped cross-section, transverse to plane P, which lamellae have a concave outer edge in the light-emission window, an inner face remote from the light-emission window, a distance $h_0$ between the outer edge and the inner face in plane P, and flanks from the outer edge to the inner face, wherein $h_0<0.1$ W.

2. A luminaire as claimed in claim 1, wherein the inner face is substantially straight.

3. A luminaire as claimed in claim 1, wherein $h_0<0.05$ W.

4. A luminaire as claimed in claim 3, wherein the inner face is convex.

5. A luminaire as claimed in claim 2, wherein the lamellae are specular and the inner face is profiled.

6. A lamellae louver for a luminaire, the luminaire having a light emission window, the lamellae louver comprising a plurality of substantially parallel, substantially equidistant, interconnected lamellae with V-shaped cross-sections, having:

a length W;

a concave outer edge capable of being mounted in the light-emission window;

an inner face remote from the light-emission window when the lamellae louver is installed in the luminaire;

flanks extending from the outer edge to the inner face; and in a center of one of said flanks, a distance $h_o$ between the outer edge and the inner face, wherein $h_0<0.1$ W.

7. A lamellae louver as claimed in claim 6, wherein the inner face is substantially straight.

8. A lamellae louver as claimed in claim 6, wherein $h_0<0.05$ W.

9. A lamellae louver as claimed in claim 8, wherein the inner face is convex.

10. A lamellae louver as claimed in claim 7, wherein the lamellae are specular and the inner face is profiled.

* * * * *